US007032618B2

(12) United States Patent
Kronenbitter

(10) Patent No.: US 7,032,618 B2
(45) Date of Patent: Apr. 25, 2006

(54) PLUMBING FIXTURE BLOCK

(75) Inventor: Bernd Kronenbitter, Nordrach (DE)

(73) Assignee: Hansgrohe AG, Schiltach (DE)

( * ) Notice: Subject to any disclaimer, the term of this patent is extended or adjusted under 35 U.S.C. 154(b) by 105 days.

(21) Appl. No.: 10/470,288

(22) PCT Filed: Nov. 22, 2002

(86) PCT No.: PCT/EP02/13121

§ 371 (c)(1),
(2), (4) Date: Jul. 24, 2003

(87) PCT Pub. No.: WO03/044288

PCT Pub. Date: May 30, 2003

(65) Prior Publication Data

US 2004/0098797 A1 May 27, 2004

(30) Foreign Application Priority Data

Nov. 23, 2001 (DE) ..... 101 58 000

(51) Int. Cl.
*F16K 11/10* (2006.01)

(52) U.S. Cl. ..... 137/606; 137/217

(58) Field of Classification Search ..... 137/216, 137/217, 606
See application file for complete search history.

(56) References Cited

U.S. PATENT DOCUMENTS

| | | | | | |
|---|---|---|---|---|---|
| 3,056,418 | A | * | 10/1962 | Adams et al. | 137/119.04 |
| 3,917,172 | A | * | 11/1975 | O'Hare | 239/305 |
| 4,013,089 | A | * | 3/1977 | Braukmann | 137/218 |
| 4,911,335 | A | * | 3/1990 | Stofle et al. | 222/192 |
| 5,095,554 | A | * | 3/1992 | Gloor | 4/678 |
| 5,325,885 | A | * | 7/1994 | Ivan et al. | 137/217 |
| 5,462,079 | A | * | 10/1995 | Loschelder et al. | 137/216 |

FOREIGN PATENT DOCUMENTS

| | | |
|---|---|---|
| DE | 24 01 869 | 7/1975 |
| DE | 37 30 375 | 3/1989 |
| DE | 38 26 064 | 4/1989 |
| DE | 196 36 851 | 3/1998 |
| EP | 0 455 998 | 11/1991 |
| EP | 0 818 586 | 1/1998 |
| WO | WO 02/097202 | 12/2002 |

* cited by examiner

*Primary Examiner*—John Fox
(74) *Attorney, Agent, or Firm*—Duane Morris LLP

(57) ABSTRACT

The invention proposes a plumbing fixture block, which has seatings for a mixing device and a shut-off valve. Furthermore, the plumbing fixture block has seatings to accommodate at least one nonreturn valve and one pipe air-release valve. The nonreturn valve and the pipe air-release valve are located one behind the other in a water channel.

13 Claims, 4 Drawing Sheets

PLUMBING FIXTURE BLOCK

Figure 1:
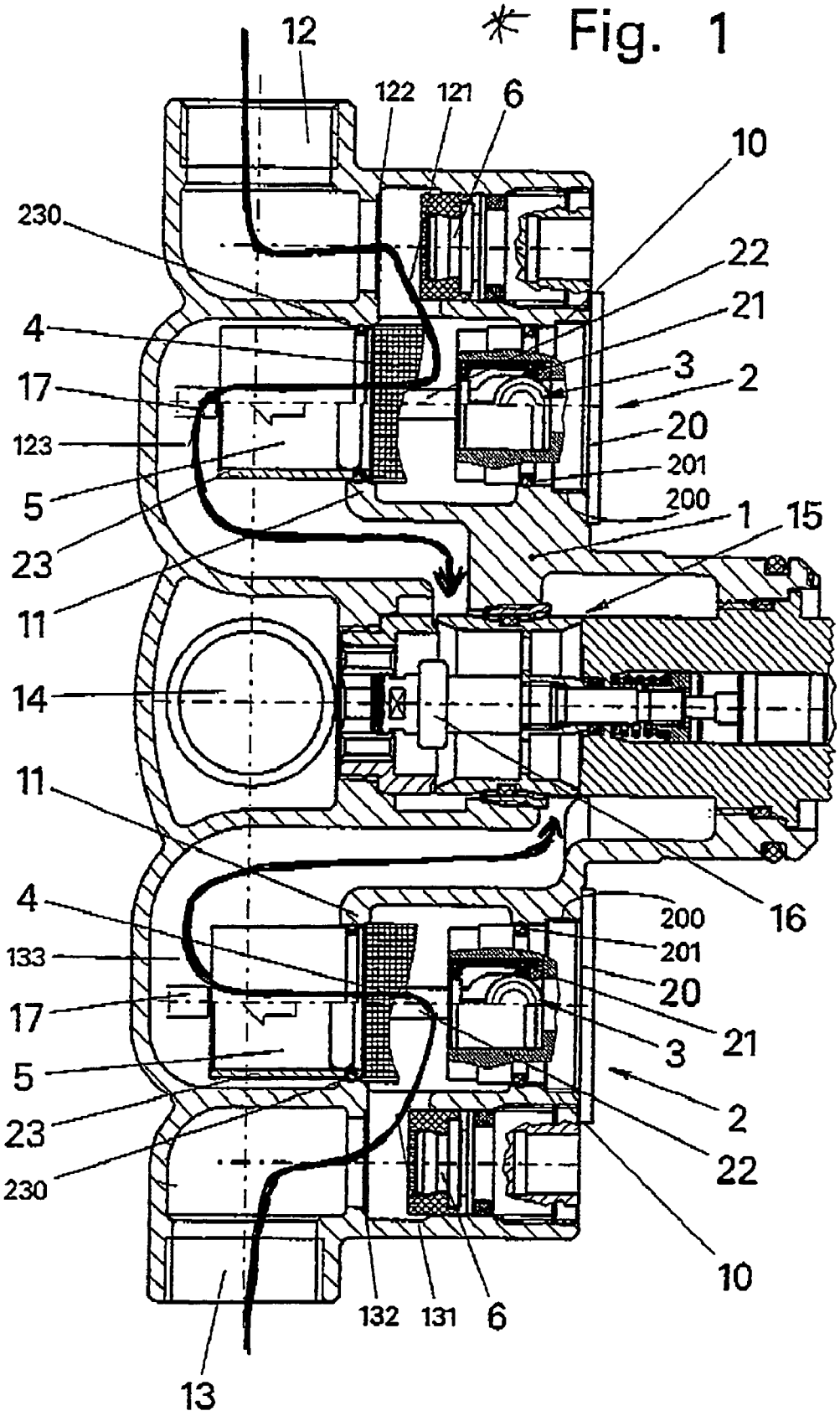

The invention concerns a plumbing fixture block, which in a domestic installation is generally concealed and connected to service pipes for hot and cold water, and on which or in which functional parts of the fixtures can be accommodated. This may, for example, involve a mixer cartridge or even a thermostatic valve.

A concealed item of this nature is already known (EP-A 2-818585). This familiar connecting sleeve contains an aerator in the form of a multi-stage valve in a drilled hole extending from a flange facing for a mixer cartridge.

Equally familiar is a concealed fixture (EP-A2-818586), to which is also connected a nonreturn valve in an outgoing flange facing for a mixer cartridge.

A plumbing fixture (EP-A1-455998) is also known, in which a safety device has been installed in a drilled hole. This safety device contains a nonreturn valve and an aerator, installed one behind the other. Both are located in the same seating.

It is the task of the invention to provide a plumbing fixture block, which is easy to maintain as the result of simple production and installation and which meets all safety regulations.

To resolve this task, the invention proposes a plumbing fixture block with the features disclosed and claimed herein.

The plumbing fixture block proposed by the invention comprises a water channel, which leads from the cold-water input connector via the seating for the mixing device to the at least one output connector. A second water channel leads from the hot-water input connector to the output connector. The seating for the mixing device is available within these water channels. A combination of a nonreturn valve and a pipe air-release valve is available in at least one water channel, in which the two devices form a functional combination. The two aforementioned components are installed one behind the other.

It is not necessary for the mixing device to be installed directly in the plumbing fixture block. It is also possible for the seating to be designed in such a way that the mixing device is installed outside the fixture block, but for it to be connected to the fixture block via a surface with corresponding openings for the water channels.

A further development of the invention may make it possible for the water channels to be at least partly configured as channels in the plumbing fixture block.

According to the invention, provision can be made for the seatings to be configured at least partly as open drilled holes to the outside of the plumbing fixture block. For the input and output connectors, here the outside can be a different side than the one used for the seating of the mixing device and the shut-off device. For example, the connection with the pipes for input and output can be placed at the rear of the plumbing fixture block, while the mixing device and the shut-off valve should be accessible from the front.

Seatings can also be provided for at least one nonreturn valve and/or at least one pipe air-release valve in the plumbing fixture block, into which the corresponding components can be installed. This may also include an open drilled hole to the outside in the case of these seatings.

A further development may include a provision in which a nonreturn valve is installed for every input connector. The pipe air-release valve is then preferably located in the output connector or the water channel leading to the output connector.

The invention proposes that at least one pipe air-release valve be installed downstream of the shut-off valve.

A further development may include a provision in which the seating for the mixing device is located in a water channel between a nonreturn valve and a pipe air-release valve.

According to the invention, provision can also be made for the seating for the shut-off valve to be located in a water channel between a nonreturn valve and a pipe air-release valve.

According to the invention, the plumbing fixture block can have a seating for a changeover valve to switch between various output connectors. This seating and the changeover valve to be installed into it are preferably configured between a nonreturn valve and a pipe air-release valve.

Another further development of the invention can be provided with the shut-off valve and the mixing device as a module in such a way that they can be installed in a common seating.

According to the invention, provision can also be made for the mixing device and the changeover valve to form a module in such a way that they can be installed in a common seating of the plumbing fixture block.

Special provision can be made for the mixing device to have a thermostat.

Figure 2:
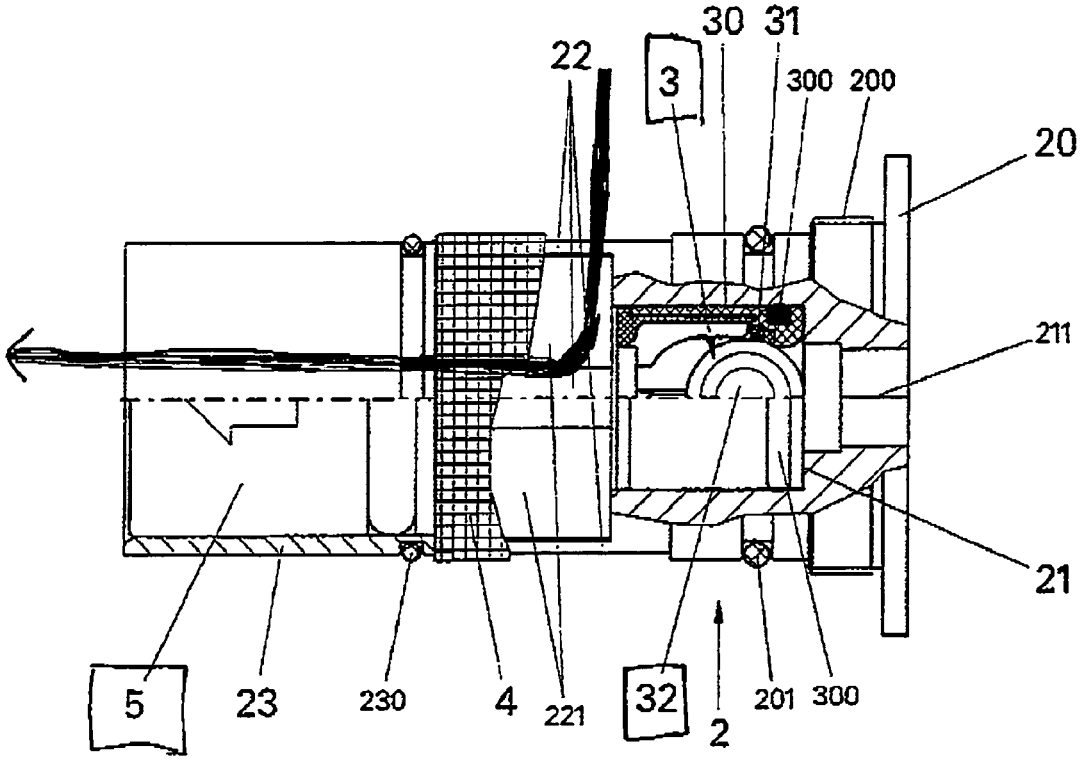
Figure 3:
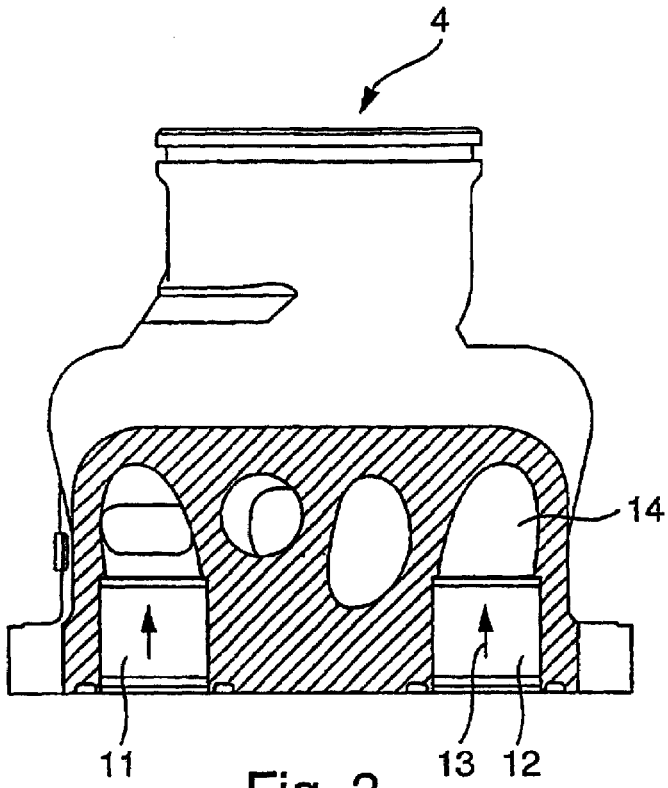
Figure 4:
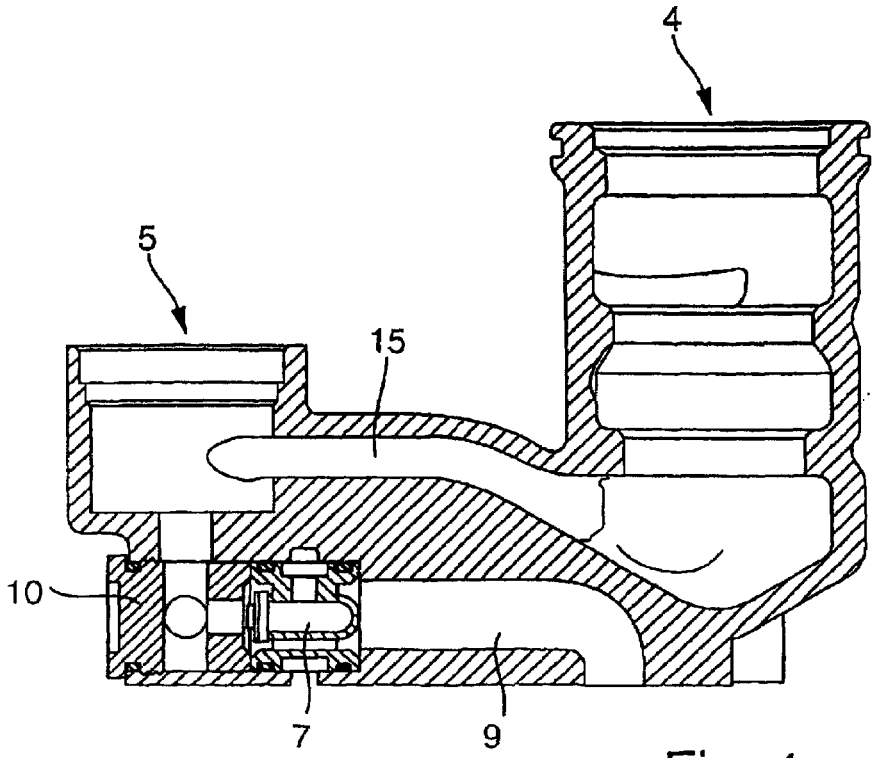
Figure 5:
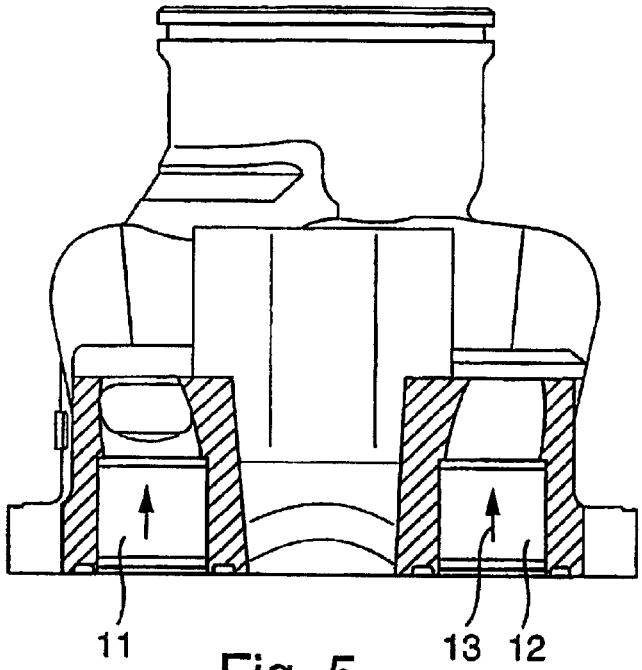
Figure 6:
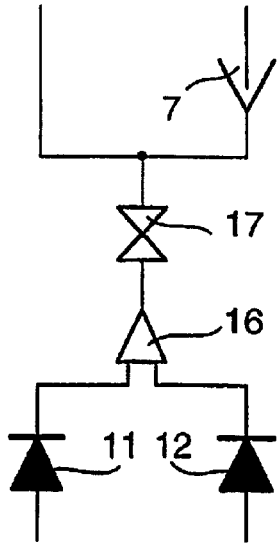
Figure 7:
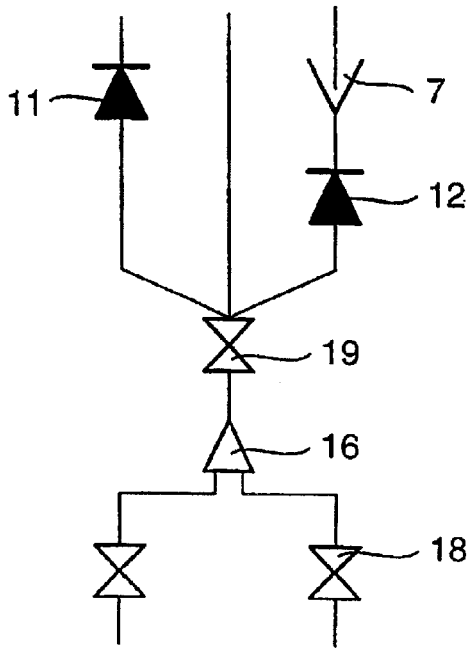
Figure 8:
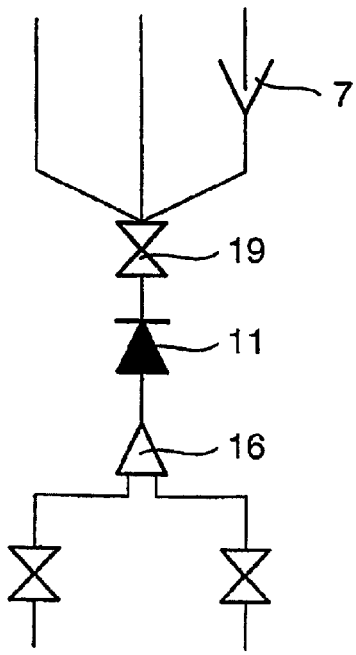
Figure 1:
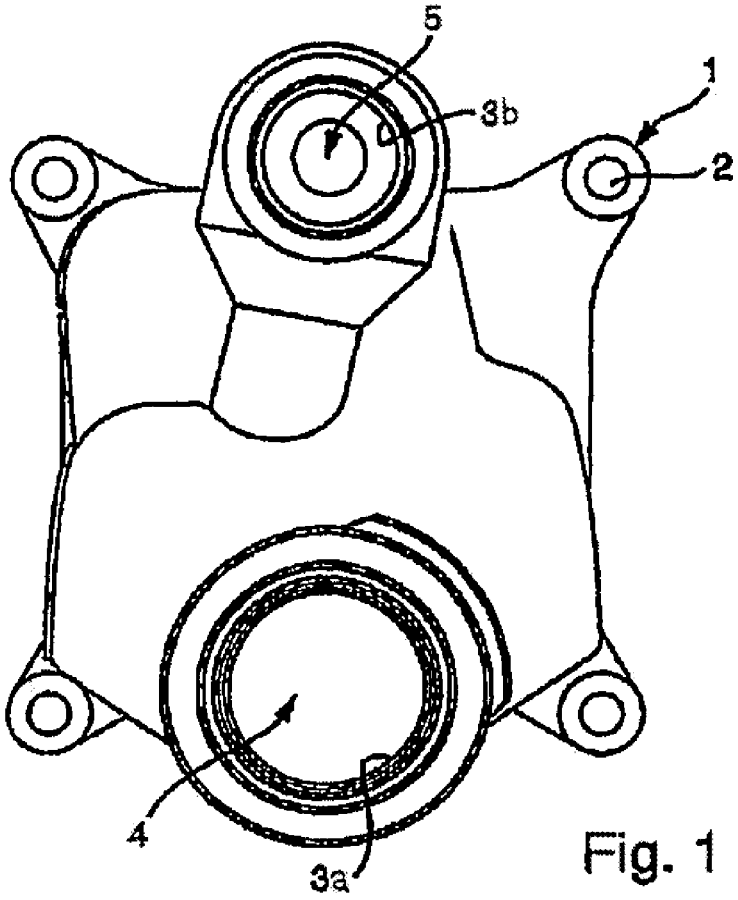
Figure 2:
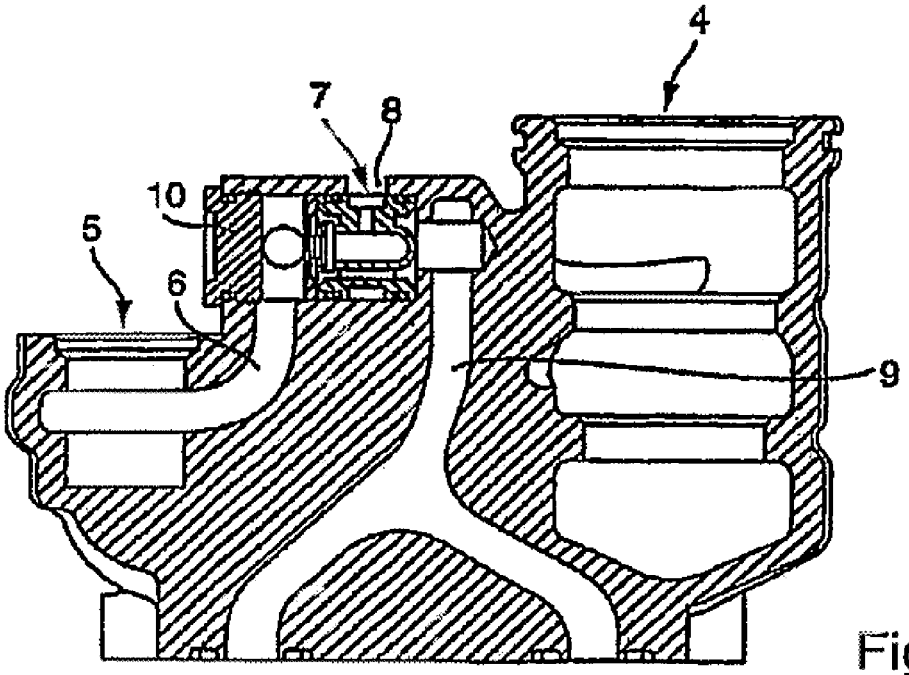

Further features, details and preferences of the invention can be found in the patent claims and the summary, the tenor of which can be found by studying the contents of the description, the following description of preferred executions of the invention and with the aid of the diagram. The following are shown in this respect:

FIG. 1 the front view of a plumbing fixture block according to the invention;

FIG. 2 a longitudinal section through the plumbing fixture block of FIG. 1;

FIG. 3 a cross-section through the plumbing fixture block of FIGS. 1 and 2;

FIG. 4 a longitudinal section, corresponding to FIG. 2, through a plumbing fixture block according to a different version;

FIG. 5 a cross-section, corresponding to FIG. 3, through a plumbing fixture block according to FIG. 4;

FIG. 6 a functional diagram of an initial version of the plumbing fixture;

FIG. 7 a functional diagram of a plumbing fixture with several output connectors;

FIG. 8 another functional diagram.

FIG. 1 shows the front of a plumbing fixture block, with an eyelet 1 at each of the four corners with a through bore hole 2, which are designed and suitable for bolting down the plumbing fixture block to a base. From the visible part of the front, drilled holes 3, for example also graduated holes are sunk into the plumbing fixture block. The lower drilled hole 3*a* in FIG. 1 is designed as seating 4 for a mixing device, while the upper-drilled hole 3*b* in FIG. 1 is designed as seating 5 of a shut-off device or a changeover valve.

Other details of the plumbing fixture block emerge from FIG. 2, which will now be the focus of attention. The seating 4 for the mixing device is indicated as a blind hole, the diameter of which differs stepwise. Details of this are not shown, as such seating is familiar. The longitudinal section of FIG. 2 shows a water channel 6 exiting the seating 5 for the shut-off or changeover valve. The water channel leads from this seating to a safety device 7. In the example shown, the safety device comprises a pipe air-release valve, which takes in air through a slot 8 in the event of negative pressure. These kinds of pipe air-release valves are familiar and so no further details are provided about them. Pipe air-release valve 8 is located in the water channel 6, which leads to another water channel 9 downstream of pipe air-release valve 8. The latter water channel leads to a tub exit.

le;2qPipe air-release valve 7 is located in a seating, which is depicted as a drilled hole entering from the outside. Following installation of pipe air-release valve 7, this drilled hole is closed from the outside with a plug 10. This makes it possible to exchange a pipe air-release valve 7 again, even if the plumbing fixture block has been installed.

While the longitudinal section of FIG. 2 depicts the water channels 6, 9 from seating 5 for the shut-off valve to the output connector, the cross-section of FIG. 3 shows the connections for the input of hot and cold water. Nonreturn valves 11, 12 are located directly in the inputs for hot and cold water. These nonreturn valves 11, 12 are familiar as commercially available modules and are identified by arrow 13. The connectors for the hot and cold water lead via the only partially depicted water channel 14 to seating 4 for the mixing device.

For the versions according to FIGS. 1 through 3, two nonreturn valves 12 are therefore in place, each located in a water channel, and a safety device in the form of a pipe air-release valve 7 is located behind the shut-off valve.

FIGS. 4 and 5 depict sections through a different version, which also corresponds to the invention. Seating 4 for the mixing device, for example a thermostatic valve, is constructed in a similar way to the version according to FIGS. 1 through 3. A water channel 15 leads from seating 4 for the mixing device to seating 5 for a changeover valve, at the output of which another pipe air-release valve 7 is located. Pipe air-release valve 7 is located in a graduated drilled hole of the plumbing fixture block, which is closed off by a plug 10 after the pipe air-release valve is installed. A water channel 9 leads from the output of the pipe air-release valve 7 to the tub exit.

FIG. 5 essentially corresponds to FIG. 3, and therefore depicts two nonreturn valves 11, 12 in the input connectors for hot and cold water.

FIGS. 6 through 8 are functional diagrams for possible alignments of nonreturn valves, shut-off devices, mixing devices and pipe air-release valves for a plumbing fixture block, as proposed by the invention and as depicted in detail in FIGS. 1 through 5.

A nonreturn valve 11, 12 is assigned to each input connector in FIG. 6. The water channels lead to a mixing device 16, which is located downstream of shut-off device 17. Two output connectors lead from shut-off device 17 to an output of the plumbing fixture, from which one leads, for example to a manual shower. A pipe air-release valve 7 is installed in the other outlet. So this outlet is protected by nonreturn valves 11, 12 and pipe air-release valve 7 in series. Shut-off device 17 may involve a shut-off device with simultaneous switchover device in order that both outlets can be controlled individually. The functional diagram in FIG. 6 depicts nonreturn valves 11, 12, in order to stop a cross-flow from one input into the other input and, at the same time, to safeguard the outlet for the manual shower.

FIG. 7 contains a functional diagram, which can also be realised with a plumbing fixture block according to the invention. Here, shut-off valves are present in both input connectors. It goes without saying that this may involve shut-off valves, which are controlled by a common device. Mixing device 16 is located downstream of both shut-off valves 18. Mixing device 16 and the two shut-off devices located downstream may involve a common module, which can be installed in a single seating 4. In this kind of valve design, i.e. where shut-off device 18 is located before mixing valve 16, it is not necessary to install nonreturn valves in the input connectors.

Another valve 19 is now installed downstream of mixing device 16, and this will primarily be a changeover valve. This change-over valve 19 switches between three different outlets, in which only one nonreturn valve 11 is located in one outlet, while a combination of a nonreturn valve 12 and a pipe air-release valve 7 is located in another outlet. A third outlet has no other safety device.

FIG. 8 depicts another functional diagram. Up to mixing valve 16, this functional diagram is identical to that in FIG. 7. However, a nonreturn valve 11 is now connected to mixing device 16; nonreturn valve 11 then leads to a changeover valve 19. Changeover valve 19 switches between three different outlets, one of which is fitted with a pipe air-release valve 7. Here again, at least one water channel has a series connection of a nonreturn valve 11 and a pipe air-release valve 7.

What is claimed is:

1. A plumbing fixture block for directing water along a flow path, comprising:

an input connector for hot water, an input connector for cold water, at least one output connector, which is connected to both said input connectors via a water channel, a seating for a mixing device, at least one seating for a shut-off valve, and at least one nonreturn valve and pipe air-release valve, which are located in at least one water channel along the flow path, one after the other.

2. The plumbing fixture block according to claim 1, wherein said water channels are at least partly executed as channels in the plumbing fixture block.

3. The plumbing fixture block according to claim 1, wherein said seatings are at least partly provided with drilled holes opening to an outside.

4. The plumbing fixture block according to claim 1, further comprising at least one seating provided for in the plumbing fixture block for at least one of said nonreturn valve and pipe air-release valve.

5. The plumbing fixture block according to claim 1, wherein at least one said nonreturn valve is provided for each said input connector.

6. The plumbing fixture block according to claim 1, wherein said a pipe air-release valve is provided for at least one said output connector.

7. The plumbing fixture block according to claim 1, wherein at least one said pipe air-release valve is installed downstream of the seating for the shut-off valve.

8. The plumbing fixture block according to claim 1, wherein the seating for the mixing device is located in a water channel between one said nonreturn valve and one said pipe air-release valve.

9. The plumbing fixture block according to claim 1, in which the seating for the shut-off valve is located in a water channel between one said nonreturn valve and one said pipe air-release valve.

10. The plumbing fixture block according to claim 1, further comprising a seating for a changeover valve to switch between several said output connectors; and wherein the changeover valve is located between one said nonreturn valve and one said pipe air-release valve.

11. The plumbing fixture block according to claim 1, in which the shut-off valve and the mixing device form a module that can be located in a common seating.

12. The plumbing fixture block according to claim 1, in which the mixing device and the change-over valve form a module that can be located in a common seating.

13. The plumbing fixture block according to claim 1, wherein the mixing device contains a thermostat.

* * * * *

UNITED STATES PATENT AND TRADEMARK OFFICE

CERTIFICATE OF CORRECTION

PATENT NO. : 7,032,618 B2
APPLICATION NO. : 10/470288
DATED : April 25, 2006
INVENTOR(S) : Kronebitter It is certified that error appears in the above-identified patent and that said Letters Patent is hereby corrected as shown below:

In the Drawings:
Please remove Sheet 1, containing Figure 1, and Sheet 2, containing Figure 2, and replace with the corrected Sheet 1, showing correct Figures 1 and 2, as shown on the copy attached hereto.

Signed and Sealed this

Tenth Day of April, 2007

JON W. DUDAS
*Director of the United States Patent and Trademark Office*